United States Patent [19]

Swenson

[11] 3,938,595

[45] Feb. 17, 1976

[54] APPARATUS AND METHOD FOR DRIVING BULB PILES

[75] Inventor: William J. Swenson, Houston, Tex.

[73] Assignee: Raymond International, Inc., Houston, Tex.

[22] Filed: Sept. 19, 1974

[21] Appl. No.: 507,558

[52] U.S. Cl. ..... 173/1; 173/11; 173/87; 254/173 R

[51] Int. Cl.[2] ..... E21B 1/04

[58] Field of Search ..... 173/1, 11, 81–89; 61/53.5; 254/172, 173 R

[56] References Cited

UNITED STATES PATENTS

| | | | |
|---|---|---|---|
| 2,241,274 | 5/1941 | Severson | 254/173 R |
| 3,073,124 | 1/1963 | Nadal | 173/87 X |

FOREIGN PATENTS OR APPLICATIONS

| | | | |
|---|---|---|---|
| 1,155,399 | 10/1963 | Germany | 173/87 |
| 852,095 | 10/1960 | United Kingdom | 173/87 |

*Primary Examiner*—Ernest R. Purser
*Attorney, Agent, or Firm*—Fitzpatrick, Cella, Harper & Scinto

[57] ABSTRACT

Method and apparatus for forming piles in the earth with a pile hammer rig having a crane, a hoisting drum carried by the crane, a driving mechanism for driving the drum through a clutch assembly, a braking assembly for the drum, a hoisting rope leading from the drum for lifting a drop-weight, an automatic sensor for sensing the top of the drop-weight stroke for disengaging the clutch mechanism, a second automatic sensor for sensing the bottom of the drop-weight stroke for engaging the drum braking assembly, and in one form of the invention an automatic sensor for sensing the rotation of the hoisting drum for disengaging the braking assembly and engaging the clutch assembly.

12 Claims, 6 Drawing Figures

APPARATUS AND METHOD FOR DRIVING BULB PILES

The present invention relates to both an apparatus and method for driving piles. More particularly, the present invention relates to an apparatus and method for the automatic driving of piles having expanded bases, bulb piles or piles with pressure injected footings.

Heretofore, bulb piles were driven into the ground in the following manner: A drive tube was positioned vertically in the leaders of a crane with the bottom thereof on grade, and a charge of dry concrete was dumped into the bottom of the drive tube. Next, the operator used a hoisting mechanism of a crane to lift and drop a dropweight, weighing about 7,000 lbs., on the dry concrete inside the tube. This process was repeated until the concrete was firmly compacted and had consolidated itself against the inside diameter of the drive tube. Thereafter, the operator continued dropping the drop-weight on the concrete plug, which engaged the drive tube and drove the tube into the ground. This operation was repeated until the tube was driven to the required depth, or resistance to tube penetration.

In order for the operator to drop the drop-weight on the concrete plug, the operator first engaged the crane hoist clutch so that the hoist raised the drop-weight to the desired height, which was typically 20 feet. Then, the operator released the clutch and the drop-weight dropped by gravity, accelerating the hoist with it. At the instant of impact, or shortly before or after, the operator engaged the hoist brake to stop the drum, and then subsequent to impact he released the brake and re-engaged the clutch to rewind the wire rope in order to lift the drop-weight for the next succeeding cycle.

When the drive tube had been driven to the required depth, further penetration thereof was prevented by anchoring the tube to the hammer rig. Thereafter, the plug was partially driven out of the bottom of the drive tube into the soil by repeated blows from the drop-weight and more concrete was dumped into the drive tube to be pounded by the drop-weight into the soil, thereby to form the bulb and compact the supporting soil.

After enough dry concrete had been pounded into the soil, the shaft of the pile was formed from additional concrete, pounded on top of the bulb while the drive tube was slowly removed. When the shaft was fully formed, or a casing sealed to the bulb, the drive tube was entirely removed from the ground, thereby completing the operation, and the rig was moved to a new pile driving location.

However, difficulties and problems were experienced with respect to the foregoing prior techniques. There was substantial dependence upon the operator's skill and often it was difficult to find competent personnel in certain locales. Operator fatigue tended to be excessive. Also, there tended to be excessive wear on the hoisting rope and head-block as a result of the rope basketing at the time when the drop-weight strikes the plug and suddenly stops, while the inertia of the rope and winding drum tries to push the drop-weight further down. Thus, when the drop-weight hits, the drum continues payingout line until it is fully stopped. This leaves a certain amount of slack which must be taken-up. Because of the cycle speed needed for economical pile driving, the slack is violently taken-up on the up-stroke, thereby causing excessive wear on the rope and headblock of the leads. The present invention is directed to certain aspects of these problems and, in addition, an application Ser. No. 507,560 filed on even date herewith of which I am a co-inventor, is also directed to the solution of these problems.

In addition, difficulties were experienced with respect to prior technique due to excessive wear on the clutch facings, since they were often used as brakes to stop the drum rotation generated by the free fall of the drop-weight prior to starting the drum in the direction used to lift the drop-weight. Such clutch facings or frictions needed frequent replacement.

The novel combination of features of the present invention are combined in such a way as to provide a very effective and practical solution of the difficulties and problems set forth above, as will become apparent as the description proceeds.

In accordance with one form of the present invention, there is provided a new and improved pile hammer rig characterized by a crane, a hoisting drum carried by the crane which is driven through clutch means and braked by braking means, and a hoisting rope leading from the drum for lifting the drop-weight. The rig is further characterized, according to one aspect, by means for automatically sensing the top of the drop-weight stroke to disengage the clutch means for releasing the drop-weight to start its free-fall. According to another aspect of the invention, means are provided for automatically sensing when the drop-weight approaches the bottom of its stroke for engaging the drum brake, and means are provided for sensing the rotation of the drum so that when its rotation terminates, the brake is disengaged and the clutch is re-engaged.

In one form of my invention the means for automatically sensing the top of the drop-weight stroke is characterized by shaft means rotatable with the drum, a lever frictionally mounted on the shaft for arcuate movement therewith, a limit switch and a stop spaced from the limit switch mounted in the arcuate path of movement of the lever. These elements are mounted in such a manner that the arcuate movement of the lever from the limit switch to the stop corresponds to the length of hoisting rope wound on the drum during the drop-weight up-stroke, and the control means are actuated by the limit switch. In another form of my invention the means for sensing the rotation of the drum are characterized by shaft means extending from the hoisting drum and rotatable therewith, a permanent magnet mounted on the shaft, a drag cup encompassing the permanent magnet, and a second shaft carried by the drag cup and rotatable therewith. In addition, vane means are mounted on the second shaft for arcuate movement and a first limit switch is actuatable by the vane at one end of its arcuate stroke while a second limit switch is actuatable by the vane at the other end of its arcuate stroke. Further, means are provided for normally maintaining the vane in a middle position between the limit switches when the shaft extending from the hoisting drum is not rotating. The second control means for disengaging the brake means and for engaging the clutch means is actuatable by one of the limit switches.

According to yet another form of the invention there is provided a pile hammer rig which is characterized by a crane, a hoisting drum carried by the crane, driving means and clutch means and braking means for the drum. A drop-weight and a hoisting rope leading from the drum for lifting the drop-weight, are provided. In addition, lever means are mounted for arcuate movement corresponding to the rotation of the drum and thereby corresponding to the stroke of the drop-weight. A bottom limit switch is mounted for engagement by the lever means at one end of its arcuate movement corresponding to the bottom of the stroke of the drop-weight and control means are provided, responsive to the bottom limit switch, for actuating the braking means of the drum. Further, a top limit switch is mounted for engagement by the lever at the other end of its arcuate movement corresponding to the top of the stroke of the drop-weight, and second control means responsive to the top limit switch are provided for disengaging the clutch means to let the drop-weight start its downward stroke. In addition, means are provided for adjusting the position of at least one of the limit switches.

According to still another aspect of the invention, I provide a new and improved method of forming a pile which includes the steps of engaging a clutch to lift the drop-weight to a preselected height by winding the rope on the drum, sensing the height by means of automatically sensing the top of the drop-weight stroke and transmitting a signal from the means for automatically sensing the top of the drop-weight stroke to an actuator for disengaging the clutch means for releasing the drop-weight to start its free-fall. According to one form of the invention, the method comprises the steps of sensing the position of the drop-weight when it approaches the bottom of its stroke and thence sending a signal to an actuator for engaging the braking means, and thereafter sensing the termination of the rotation of the drum and sending a signal, when said rotation of the drum terminates, to a brake actuator for releasing the braking means while simultaneously sending a signal to a clutch actuator for re-engaging the clutch means to again lift the drop-weight.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other structures and methods for carrying out the several purposes of the invention. It is important, therefore, that this disclosure be regarded as including such equivalent constructions and methods as do not depart from the spirit and scope of the invention.

Several embodiments of the invention have been chosen for purposes of illustration and description, and are shown in the accompanying drawings, forming a part of the specification, wherein:

FIG. 3 is a graphical representation of the operational characteristics of various elements of the pile hammer rig during one cycle of operation;

Figures 1, 2:
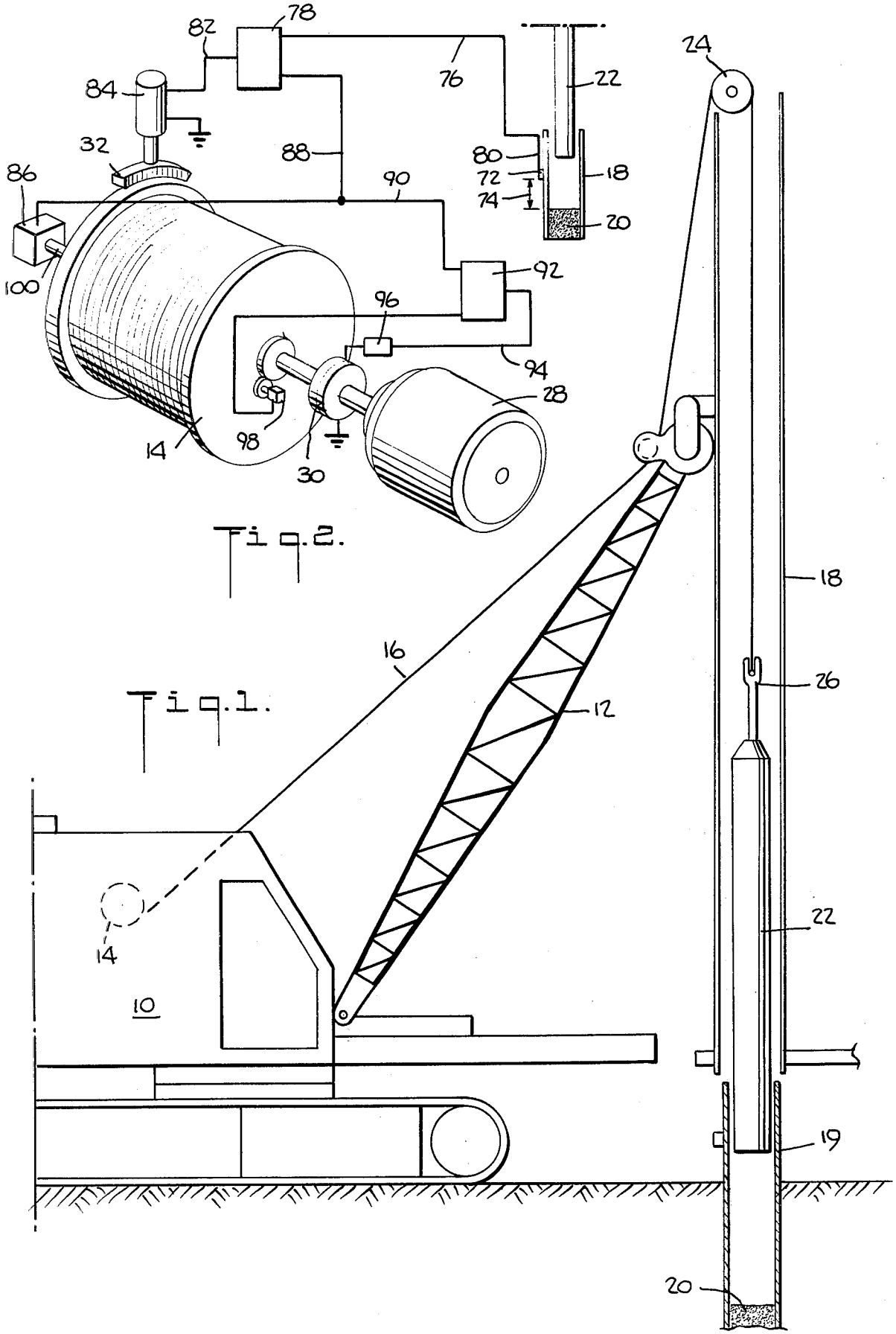
FIG. 1 is a side elevation of a bulb pile hammer rig constructed in accordance with the concepts of my invention.
FIG. 2 is an enlarged, perspective view of a hoisting drum and includes a block diagram of a control system for controlling the operation of the drum, according to the invention.
Figure 8:
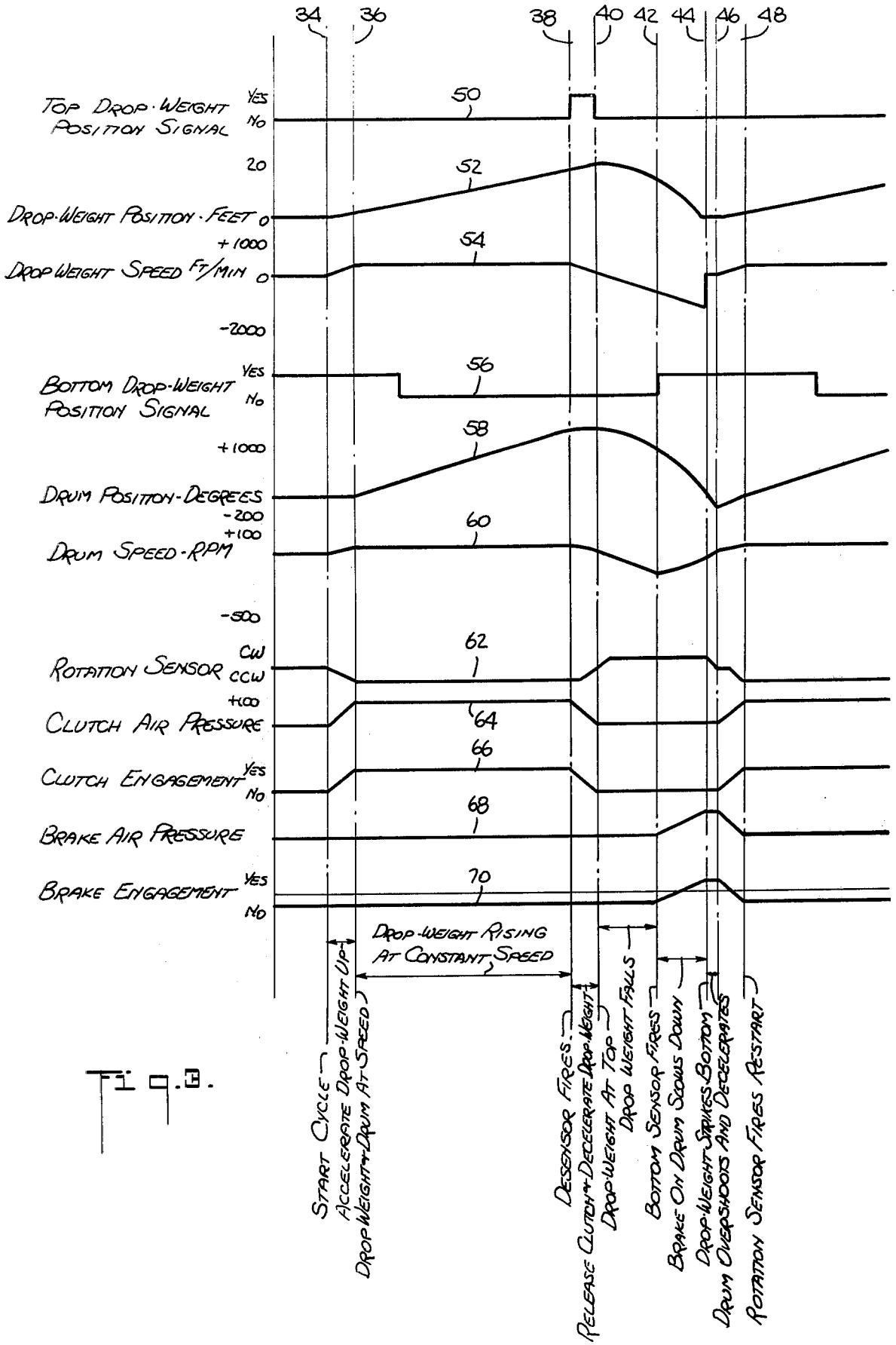

Referring to the drawings in detail, and initially to FIG. 1, there is shown a bulb pile hammer rig, which includes a crane 10, boom 12 carrying leaders 18 and hoisting means, which include a drum 14 that carries a length of wire rope 16. A drive tube 19 is positioned vertically in the leaders and a charge of dry concrete is dumped into the bottom thereof to form a plug 20, by means of a ram or drop-weight 22, which typically weighs about 7,000 lbs. and is normally about 12 inches in diameter and about 19 feet long. Typically, drive tubes have an inside diameter which varies from about 16 inches to about 20 inches, for example. The wire rope 16 is led from the drum 14 over a headblock 24, down through a swivel assembly 26 that is connected to the top of the drop-weight 22.

In operation, the drop-weight 22 is lifted by the wire rope 16 by winding the drum 14, which is driven by a motor 28, FIG. 2, through air actuated clutch means 30 and then allowed to fall freely by releasing the clutch means. This cycle of operation is continuously repeated to form the plug 20 in the bottom of the open-ended drive tube 18, which is then utilized to drive the tube into the ground and to thence compact and extrude additional concrete below the end of the tube for forming an expanded base. Various lengths of drops are used with the maximum normally being about 20 feet. During the drop, the drum 14 is accelerated to a rotational speed dictated by the velocity of the drop-weight 22, and at a preselected time before the moment of impact, the operator applies a brake 32, FIG. 2, to bring the drum to rest. Thereafter, the clutch is re-engaged and the drop-weight is again lifted. Heretofore, excessive wear occurred on the clutch facings as they were often re-engaged before the drum had completely come to rest and, consequently, used as brakes to stop the drum rotation generated by the free-fall of the drop-weight. In addition, the wire rope tended to wear excessively due to the basketing effect created at the time of impact of the drop-weight due to the inertia of the rope and drum. Thus, when the drop-weight hit, the drum continued to pay-out rope until it was finally stopped. This left a certain amount of slack which had to be taken-up but, because of the cycle speed need for economical pile driving, the slack was violently taken-up on the up-stroke, thereby causing excessive wear on the rope and headblock.

The object of automation, according to the present invention, is to relieve the operator of repetitive manipulation of the hoist controls and to properly operate the brake and clutch. Proper use of the brake for stopping the drum will remove this operation from the clutch so that wear may be evenly divided between the clutch and the brake. Additionally, proper synchronization of the brake, clutch and drop-weight impact, will reduce the basketing and jerk on the wire rope. This will yield longer life for the rope and the headblock. In the prior art technique, the operator observed the position of a mark on the rope to determine when the drop-weight had been lifted to the proper height of 20 feet. He used the same mark, or sometimes the sound of the impact of the drop-weight on the plug, to determine the bottom of the stroke, and the time for engaging the clutch. Consequently, for purposes of automation, the operator's visual acoustic observations must be replaced by sensor devices. Since the brake is used to stop the drum before the clutch is re-engaged, it is necessary to be sure that the brake has stopped the drum completely before it disengages itself when the clutch comes into operation. This means that a drum rotation sensor must be used. The top and bottom drop-weight position sensors produce simple yes-no functions. The drop-weight and drum positions are not measured continuously, but only the extreme positions are monitored. The rotation sensor is intended to signal the presence or absence of rotation. The clutch and brake air pressure and engagement could either be characterized by discrete on-off operation or transient responses. These responses are indicated in FIG. 3 on the horizontal axis, as transient responses. The control sequence with respect to time is shown in FIG. 3. The cycle starts with the drop-weight resting on the plug as indicated by the vertical broken line 34, FIG. 3. Between the broken lines indicated at 34 and 36 in FIG. 3, air is gradually introduced to the clutch as shown by curve 64 and it engages the hoist drum, shown by curve 66, to accelerate the drum, curve 60, and drop-weight, curve 54, up to operating speed in the lifting direction. As indicated at the broken line 36, the drop-weight and drum reach their normal speed, and between vertical lines 36 and 38 hoisting continues with the drop-weight rising, curve 52, at a constant speed. At the vertical line 38, the top dropweight position sensor, curve 50, indicates that the dropweight has neared the top of its stroke and signals for release of the clutch air pressure. Between the lines 38 and 40, the pressure is released from the clutch, curve 64, to disengage same, curve 66, and the drop-weight, curve 54, and the drum, curve 60, decelerate. At vertical line 40 the drop-weight is at its highest point, as illustrated by curve 52. Between the vertical lines 40 and 42, the drop-weight falls under the influence of gravity, indicated by curve 52, thereby accelerating the drum as it draws line from the hoist, as illustrated by curves 58 and 60. At the vertical line 42, the drop-weight actuates the bottom position sensor, curve 56, to signal that it is approaching the bottom of its stroke. It is noted that there is some anticipation here in order to allow time for the application of the drum brake prior to drop-weight impact. Between the lines 42 and 44, air is supplied to the brake as indicated by the curve 68, and the brake engages the drum, curve 70, to gradually slow it down, as indicated by the curve 60. Vertical line 44 indicates where the drop-weight strikes the plug, delivering most of the potential energy stored by its lift, as indicated by curves 52 and 54. After impact of the drop-weight, the drum continues to turn because the brake cannot stop it instantly as indicated between the lines 44 and 46, so that the drum pays-out some slack line while coming to a complete stop, as indicated by the curves 58 and 60. Slightly after impact, the drum rotation sensor signals that the drum has stopped as indicated by curve 62, thereby causing the brake air to be released as illustrated by curve 68 to release the brake, curve 70, and causing air to be supplied to the clutch to re-engage the clutch as indicated by curves 64 and 66. This re-starts the cycle.

It is noted that between the vertical lines 42 and 44 there is still some expectation that the drum and rope will over-shoot. In prior art apparatus, when the brake was engaged early enough in the cycle to prevent any over-shooting, then all of the energy stored in the drop-weight was dissipated in the brake. When all of the drop-weight energy was transferred to the plug, then no-braking could be applied before impact. Consequently, some compromise had to be made between full energy delivery and no rope slack. This is eliminated, with the present rigging, by employing some method to accommodate the drum over-shoot, such as a spring or sprung head-block, for example. Automation alone of the present rig cannot eliminate slacking and jerking of the rope, as will be discussed more fully hereinafter.

Referring in particular to FIG. 2, there is shown a system for sensing the bottom position of the ram, which includes a small pod mounted on the outside surface of the drive tube 18 that contains an electromagnetic metal detector 72. Any suitable type of detector may be employed such as one that produces an electrical signal when a metallic metal body passes adjacent thereto, for example. The pod is mounted a selected distance, as indicated at 74, above the plug 20. For perfect operation this would require that the height of the plug in the drive tube 18 be constant. However, in practice, the plug height, though not absolutely constant, varies little enough to ensure satisfactory operation of the rig. Thus, as drop-weight 22 passes adjacent the electromagnetic metal detector 72, the detector sends an electrical signal through an electrical cable 76 to a first control circuit 78 located in the crane cab. The cable is enclosed in a heavy steel conduit welded to the side of the drum tube 18, as at 80. It will be appreciated that the detector 72 is out of the way of the drop-weight and is not affected by concrete splatter within the tube. When a signal is received from the electromagnetic metal detector, the first control circuit 78 sends a signal through a lead 82 to a solenoid actuated valve 84 which actuates the air operated brake 32 to thereby stop the rotation of the drum 14.

Still referring to FIG. 2, a rotation sensor 86 is connected to the drum 14 through a shaft 100. This sensor indicates whether or not the drum is rotating. The rotation sensor has a lead 88 connected to the first control circuit 78 so that when the drum comes to a stop due to the action of the brake 32, the rotation sensor sends a signal to cause the first control circuit 78 to disconnect the solenoid actuated valve and release the air operated brake 32. Simultaneously, the rotation sensor sends a signal through a lead 90 to a second control circuit 92 which, in turn, sends a signal through a lead 94 to a solenoid actuated valve 96 that actuates the air operated clutch 32 to engage the clutch and start the drum to rotate for the purpose of again lifting the drop-weight 22. In addition, mounted adjacent the drum 14 is an angular rotation or top of the drop-weight stroke sensor 98, which is set to send an electrical signal after the drum has rotated through a predetermined angle of rotation corresponding to the height to which the drop-weight is to be lifted prior to dropping, i.e. 20 feet, for example. Thus, when the drum has rotated through the prerequisite angle of rotation, the top of the stroke rotation sensor 98 sends a signal to the second control circuit 92, which disconnects the solenoid actuated valve 96 and releases the air operated clutch 30, thereby allowing the drop-weight to start its downward stroke.

Figure 4:
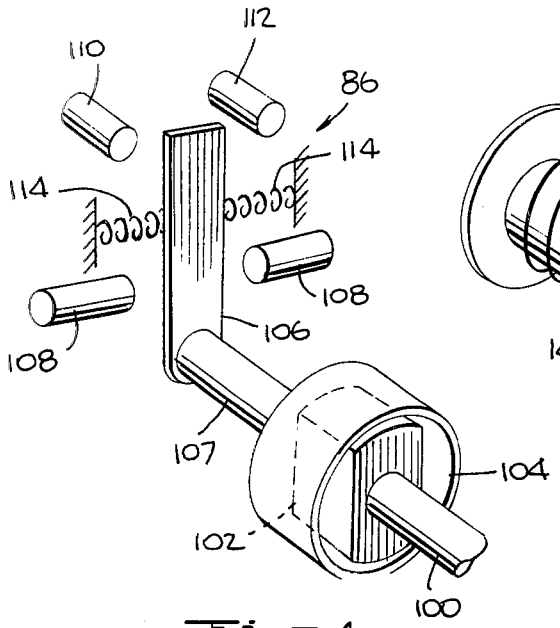
FIG. 4 is an enlarged, perspective view of a drum shaft rotation sensor.

FIG. 4 shows one type of shaft rotation sensor, which may be employed as the rotation sensor 86 shown in FIG. 2. This sensor determines whether or not the shaft 100, connected to the drum, is turning without determining the speed thereof. The shaft 100 is provided with a permanent magnet 102 that fits inside a drag cup 104. When the magnet turns it generates voltage inside the drag cup that produces corresponding currents to generate a torque in the direction of rotation of the magnet and shaft 100. A vane 106 is attached to a shaft 104 carried by the cup 104 so that rotation of the shaft 107 will move the vane in one or the other directions, until it rests against one of the stops 108. When the vane moves in either direction by the torque from the drag cup, it triggers one of a pair of proximity switches 110 and 112 to break the control circuit and thereby indicate rotation of the shaft 100 in that direction. When rotation ceases, the currents and voltages terminate and centering springs 114 return the vane to its neutral, central position, away from either proximity switch, thus indicating no rotation of the shaft 100. As a result, when the drum comes to rest after being braked by the drum brake 32, FIG. 2, a signal is sent via the lead 88 through the first control circuit 78 to release the air actuated brake 32 and also a second signal is sent via the lead 90 through the second control circuit 92 to engage the air actuated clutch 30. It will be appreciated that there is a threshold speed, when the shaft is actually turning, but the device fails to indicate voltage, which is determined by the torque induced by the centering springs and the drag cup spindle bearings. However, the stops in conjunction with the centering springs, may be so adjusted as to minimize this threshold speed. It will also be appreciated that for certain installations, the magnetic drag cup could be replaced by fluid means, if desired. The proximity switches 110 and 112 may be electric, electronic, photoelectric, or fluidic, as desired. The two proximity switches may be replaced by one central switch when it is not necessary to determine the particular direction of rotation of the shaft 100.

Figure 5:
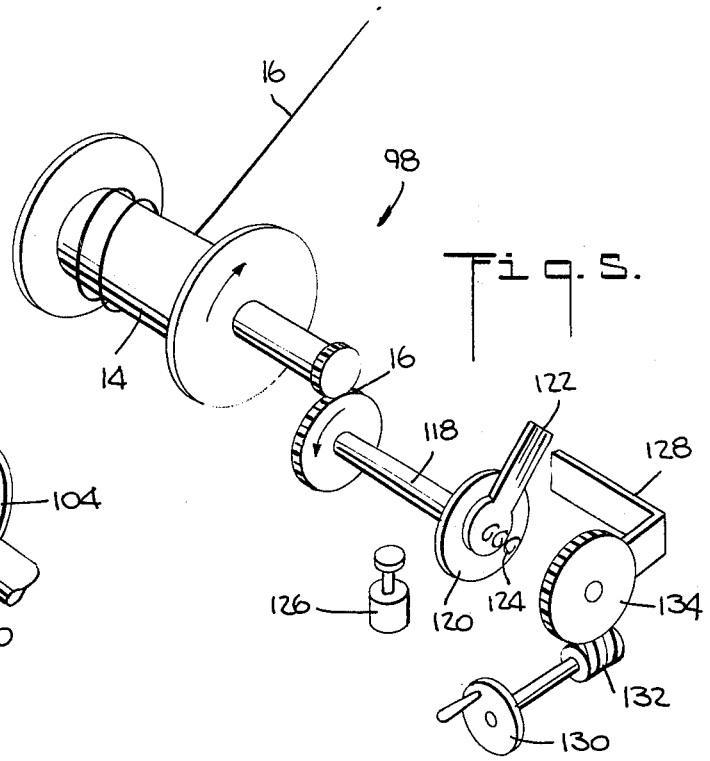
FIG. 5 is an enlarged, perspective view of a sensor for sensing the top of the drop-weight stroke.

Referring next to FIG. 5, there is shown one type of top of the drop-weight stroke sensor, which may be employed as the sensor 98 in FIG. 2. The hoist drum 14 is connected by gearing 116 to a shaft 118 onto which is fixed a friction disc 120. A lever 122 is loosely mounted on the shaft 118 and pressed against the friction disc 120 by a spring 124. In operation, the shaft 118 rotates with the drum and carries the lever 122 with it, through a preselected arc that represents 20 feet, for example, of hoisting rope on the drum 14. When the drum turns clockwise, as viewed in FIG. 5, it lifts the drop-weight, while moving the lever 122 towards a limit switch 126 that acts through the second control circuit 92, FIG. 2, to actuate the solenoid valve 96 to disengage the air operated clutch 30. After the lever 122, FIG. 5, actuates the limit switch 126, the friction disc 120 slips while the drum slows down. With the clutch disengaged, the ram drops on its downstroke, and the lever 122 then moves towards a stop 128. When the 20 feet of hoisting line has been paid-out, the lever strikes the stop 128. Further line pay-out from drum overshoot and/or pile settlement, causes the lever 122 to slip on the shaft 118. When the rig begins its up-stroke, there is still a 20 feet equivalent arc through which the lever travels before actuating the top of the stroke limit switch 126. It will be appreciated that the indicated lift or lever movement begins with the drum rotation and, if there is slack, the drop-weight may not be lifting initially. Further, the over-shoot causes a certain amount of drop-weight lift to occur after the lever contacts the limit switch 126. Thus, the 20 feet equivalent arc includes the slack from the previous drop. Therefore, the actual drop-weight lift would be slightly less than 20 feet. However, on the average the difference can be accommodated by adjusting the stop position. That is, for strokes other than 20 feet, the position of the stop 128 can be adjusted by means of an adjustment wheel 130 acting through a worm 132 and geat 134 provided for the purpose.

Figure 6:
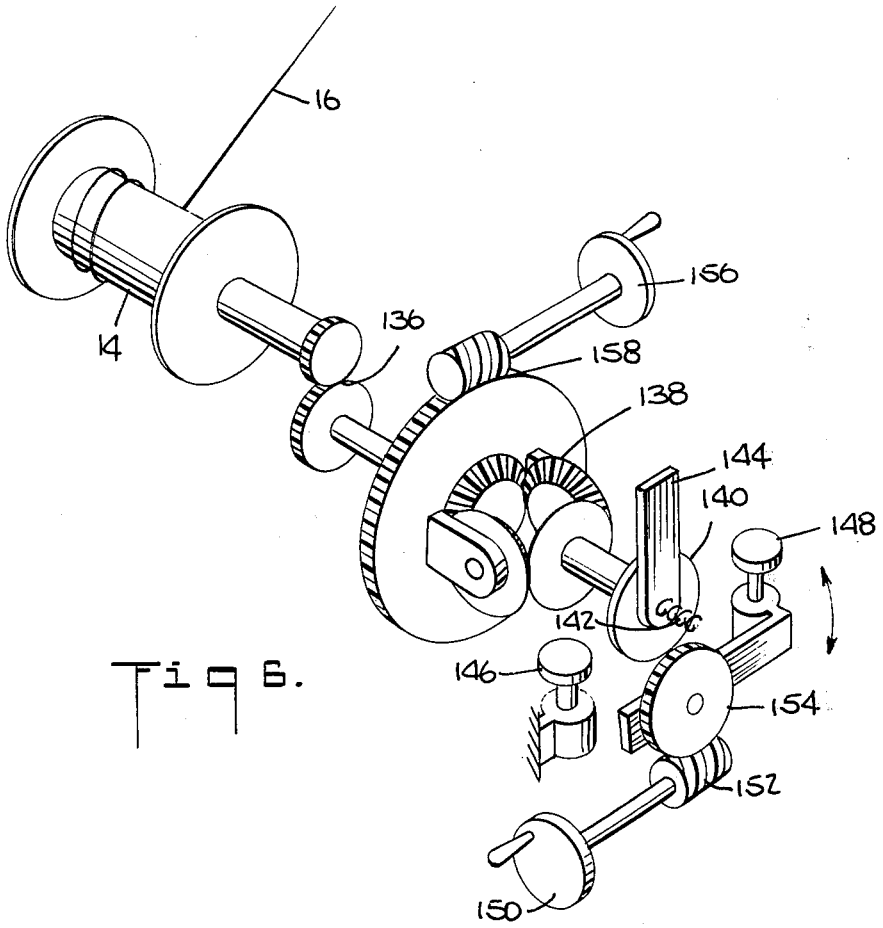
FIG. 6 is an enlarged, perspective view of another system for controlling the stroke of the drop-weight in a bulb pile hammer rig, in accordance with the invention.

In FIG. 6, there is illustrated another form of control system constructed according to the concepts of my invention. In this system both the top and the bottom of the ram strokes are controlled by limit switches that are actuated indirectly by the drum. The drum 14 drives through suitable gearing 136 and a differential gear assembly 138, a friction disc 140, against which a friction spring 142 holds a lever 144. Thus, the drum rotation swings the lever 144 through an arc that represents the stroke of the drop-weight, which may be 20 feet, for example. At one end of the arc, the lever 144 actuates a fixedly mounted bottom limit switch 146, which actuates the drum brake 32, FIG. 1, and after a predetermined time delay for the drum to stop engages the clutch 30 to start the drop-weight. As seen in FIG. 6, at the other end of the arc, the lever 144 actuates a top limit switch 148, which signals the second control circuit 92 to disengage the clutch 30, FIG. 1, to let the drop-weight fall. The position of the bottom simit switch 146 is fixed, while the position of the top limit switch 148 is adjustable by means of an adjustment wheel 150 acting through a worm 152 and gear 154. This adjustment varies the arc between the two limit switches and thus the amount of rotation of the hoist drum and the stroke of the drop-weight. The differential 138 is adjustable by means of an adjustment wheel 156 acting through a worm and gear 158 to permit lowering or raising the elevation or depth of the stroke, while still maintaining the same interval between the top and bottom of the stroke. The friction disc 140 and the spring 142 are strong enough to throw the limit switches, but will slip to prevent damage to the drum and switches in the event of over-shoot, and/or unexpected failure of the brake engagement or clutch release. This system requires that the operator continually adjust the depth of the stroke, by means of the adjustment wheel 156, while the drive tube is being driven into the ground to compensate for the travel of the tube into the ground by virtue of each stroke. However, this system can also be used, with continuous depth adjustment to compact the shaft concrete when the drive tube is being withdrawn. The limit switches 146 and 148 can either be electric or pneumatic, as desired.

I have found that there is some expectation of drum and hoisting rope over-shoot, even with an automated brake hammer rig. That is, if the brake is engaged early enough in the cycle to prevent any over-shoot, then nearly all of the energy stored in the drop-weight is dissipated in the drum brake. If all the drop-weight energy is transferred to the plug, then enough braking may be applied before impact. Thus, it would appear that some compromise must be made between full energy delivery and no hoisting rope slack. However, I have found that this could be eliminated to a substantial extent by employing some method to accommodate the drum over-shoot, such as a spring mounted swivel or a spring mounted headblock. Such a system is shown in my copending application filed on even date herewith.

Thus, it will be appreciated that the present invention does indeed provide a new and improved apparatus and method for driving bulb piles, which releases the operator of repetitive manipulation of the hoisting controls and properly operates the drum brake and clutch mechanisms. Proper use of the brake for stopping the drum removes this service from the clutch, thereby evenly dividing the wear between the clutch and the brake. Additionally, the provision of proper synchronization of the brake, clutch and ram impact reduces the basketing and jerking of the hoisting rope, thereby yielding longer life for the rope and headblock. In addition, the present invention reduces the dependency on the operator's skill and provides consistent blow characteristics, as well as increasing the speed of the cycle time and reducing the operator's fatigue factor.

Although certain particular embodiments of the invention are herein disclosed for purposes of explanation, various modifications thereof, after study of this specification, will be apparent to those skilled in the art to which the invention pertains.

What is claimed and desired to be secured by Letters Patent is:

1. A pile hammer rig comprising a crane, a hoisting drum carried by said crane, driving means and clutch means and braking means for said drum, a drop-weight, a hoisting rope leading from said drum for lifting said drop-weight, means for automatically sensing the top of the drop-weight stroke, and control means responsive to said means for automatically sensing the top of the drop-weight stroke for disengaging said clutch means for releasing said drop-weight to start its free-fall, said means for automatically sensing the top of the drop-weight stroke comprising shaft means rotatable with said drum, a lever frictionally mounted on said shaft means for arcuate movement therewith, a limit switch and a stop spaced from said limit switch mounted in the arc of movement of said lever, whereby the arcuate movement of said lever from said limit switch to said stop corresponds to the length of hoisting rope wound on said drum during the drop-weight up-stroke, and said control means being actuated by said limit switch.

2. A pile hammer rig comprising a crane, a hoisting drum carried by said crane, driving means and clutch means and braking means for said drum, a drop-weight, a hoisting rope leading from said drum for lifting said drop-weight, means for automatically sensing the top of the drop-weight stroke, and control means responsive to said means for automatically sensing the top of the drop-weight stroke for disengaging said clutch means for releasing said drop-weight to start its free-fall, said means for automatically sensing the top of the drop-weight stroke comprising a shaft, reduction gearing for connecting said drum to said shaft, a friction disc fixedly mounted on said shaft for rotation therewith, a lever mounted on said shaft for arcuate movement, spring means for resiliently urging said lever against said friction disc for rotation therewith, a limit switch mounted in the arc of movement of said lever, a limit switch and a stop spaced from said limit switch mounted in the arc of movement of said lever, whereby the arcuate movement of said lever from said limit switch to said stop corresponds to the length of hoisting rope wound on said drum during the drop-weight's up-stroke, and said control means being actuated by said limit switch.

3. A pile hammer rig comprising a crane, a hoisting drum carried by said crane, driving means and clutch means and braking means for said drum, a drop-weight, a hoisting rope leading from said drum for lifting said drop-weight, means for automatically sensing the bottom of the drop-weight stroke, and control means responsive to said means for automatically sensing the bottom of the drop-weight stroke for engaging said brake means, said means for automatically sensing when the drop-weight approaches the bottom of its stroke comprising an electromagnetic metal detector mounted adjacent the outside surface of a drive tube for detecting the presence of said drop-weight adjacent thereto and said control means being actuated by said electromagnetic metal detector.

4. A pile hammer rig comprising a crane, a hoisting drum carried by said crane, driving means and clutch means ad braking means for said drum, a drop-weight, a hoisting rope leading from said drum for lifting said drop-weight, means for automatically sensing when said drop-weight approaches the bottom of its downward stroke, control means responsive to said means for automatically sensing when the drop-weight approaches the bottom of its stroke for engaging said brake means, means for sensing the rotation of said drum, and second control means for releasing said brake means and for engaging said clutch means when said drum terminates its rotation.

5. A pile hammer rig according to claim 4 wherein said means for sensing the rotation of said drum comprises shaft means extending from said hoisting drum and rotatable therewith, a permanent magnet mounted on said shaft means, a drag cup encompassing said permanent magnet, a second shaft carried by said drag cup and rotatable therewith, vane means mounted on said second shaft for arcuate movement, a first limit switch means actuatable by said vane at one end of its arcuate stroke and a second limit switch means actuatable by said vane at the other end of its arcuate stroke, means for normally maintaining said vane in a middle position between said limit switching means when the shaft means extending from said hoisting drum is not rotating, said second control means for disengaging said brake means and for engaging said clutch means being actuatable by one of said limit switching means.

6. A pile hammer rig according to claim 4 wherein said means for sensing the rotation of said drum comprises a shaft extending from said hoisting drum and rotatable therewith, a permanent magnet mounted on said shaft, a drag cup encompassing said permanent magnet, a second shaft carried by said drag cup and rotatable therewith, a vane mounted on said second shaft for rotation therewith, a first stop for limiting the arcuate movement of said vane in one direction and a second stop for limiting arcuate movement of said vane in the opposite direction, a limit switch associated with each of said stops actuatable by said vane when adjacent said corresponding stop, and resilient means for normally maintaining said vane in a neutral position between said proximity switches when the shaft extending from said hoisting drum is not rotating, said control means for disengaging said brake means being actuatable by one of said proximity switches.

7. A pile hammer rig comprising a crane, a hoisting drum carried by said crane, driving means and clutch means and braking means for said drum, a drop-weight, a hoisting rope leading from said drum for lifting said drop-weight, automatic means for sensing the top of the drop-weight stroke, first control means responsive to said means for automatically sensing the top of the drop-weight stroke for disengaging said clutch means to release said drop-weight to start its free-fall, means for automatically sensing when the drop-weight approaches the bottom of its stroke, second control means responsive to said means for automatically sensing when the drop-weight approaches the bottom of its stroke for engaging said brake means, means for automatically sensing the rotation of said drum, third control means responsive to said means for automatically sensing the rotation of said drum for releasing said brake means when the rotation of said drum has terminated and for re-engaging said clutch means.

8. A pile hammer rig comprising a crane, a hoisting drum carried by said crane, driving means and clutch means and braking means for said drum, a drop-weight, a hoisting rope leading from said drum for lifting said drop-weight, lever means, means mounting said lever means for arcuate movement corresponding to the rotation of said drum and thereby corresponding to the stroke of the drop-weight, a bottom limit switch mounted for engagement by said lever means at one end of its arcuate movement corresponding to the bottom of the stroke of said drop-weight, control means responsive to said bottom limit switch for actuating said braking means for said drum, a top limit switch mounted for engagement by said lever means at the other end of its arcuate movement corresponding to the top of the stroke of said drop-weight, second control means responsive to said top limit switch for disengaging said clutch to let the drop-weight start its downward stroke, and means for adjusting the position of at least one of said limit switch means.

9. A pile hammer rig comprising a crane, a hoisting drum carried by said crane, driving means and clutch means and braking menas for said drum, a drop-weight, a hoisting rope leading from said drum for lifting said drop-weight, a gear reduction assembly driven by said drum, a differential gear assembly driven by said gear reduction assembly, a friction disc driven by said differential gear assembly, a lever mounted for arcuate movement disposed adjacent said friction disc, spring means for resiliently urging said lever against said friction disc whereby rotation of said drum swings said lever through an arc corresponding to the winding of the rope on the drum and thereby the stroke of the drop-weight, a fixedly mounted bottom limit switch mounted for engagement by said lever at one end of said arc, control means responsive to said bottom limit switch for actuating said braking means for said drum, a top limit switch mounted for engagement by said lever at the other end of its arc, second control means responsive to said top limit switch for disengaging said clutch to let the drop-weight start its downward stroke, means for adjusting the arcuate position of said top limit switch to thereby adjust the length of said arc and thereby adjust the stroke of the drop-weight, and means for adjusting said differential gear assembly to permit lowering and raising the elevation of the stroke while maintaining the same interval between the top and bottom of the stroke.

10. A method of forming a pile with a pile hammer rig including a crane having a hoisting drum, a clutch, driving means for said drum through said clutch, braking means for the drum, a drop-weight, a hoisting rope leading from said drum to said drop-weight, said method comprising the steps of engaging said clutch means to lift said drop-weight to a preselected height by winding the rope on the drum, disengaging said clutch means for releasing said drop-weight to start its free fall, automatically sensing when the drop-weight approaches the bottom of its stroke, and transmitting a signal for engaging said braking means, automatically sensing the rotation of said drum and transmitting a signal when the rotation of said drum terminates for releasing said braking means and for re-engaging said clutch means.

11. A method of forming a pile with a pile hammer rig including a crane having a hoisting drum, a clutch, driving means for said drum through said clutch, braking means for the drum, a drop-weight, a hoisting rope leading from said drum to said drop-weight, lever means, means mounting said lever means for arcuate movement corresponding to the rotation of the drum and thereby corresponding to the stroke of the drop-weight, said method comprising the steps of engaging said clutch to lift said drop-weight to a preselected height by winding the rope on the drum, sensing said height by means of automatically sensing the top of the drop-weight stroke, transmitting a signal from said means for automatically sensing the top of the drop-weight stroke to an actuator for disengaging said clutch means for releasing said drop-weight to start its free-fall, sensing when said drop-weight approaches the bottom of its stroke, and transmitting a signal when said drop-weight approaches the bottom of its stroke to an actuator for engaging said braking means.

12. A method of forming a pile with a pile hammer rig including a crane having a hoisting drum, a clutch, driving means for said drum through said clutch, brake means for the drum, a drop-weight, a hoisting rope leading from said drum to said drop-weight, said method comprising the steps of engaging said clutch to lift said drop-weight to a preselected height by winding the rope on the drum, sensing said height by means for automatically sensing the top of the drop-weight stroke, transmitting a signal from said means for automatically sensing the top of the drop-weight stroke to an actuator for disengaging said clutch means for releasing said drop-weight to start its free-fall, sensing the position of said drop-weight when it approaches the bottom of its stroke and sending a signal to an actuator for engaging said braking means, sensing the termination of rotation of said drum, sending a signal when said rotation of the drum terminates to the brake actuator means for releasing said braking means and sending a signal to said clutch actuator for re-engaging said clutch means to again lift said drop-weight.

* * * * *

UNITED STATES PATENT OFFICE

CERTIFICATE OF CORRECTION

Patent No. 3,938,595 Dated February 17, 1976

Inventor(s) William Swenson

It is certified that error appears in the above-identified patent and that said Letters Patent are hereby corrected as shown below:

Column 8, line 10, "geat" should read --gear--;

Column 8, line 29, "simit" should read --limit--;

Column 10, line 18, Claim 4, "ad" should read --and--;

Column 11, line 37, Claim 9, "menas" should read --means--;

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*